US005809900A

United States Patent [19]

Alexander et al.

[11] Patent Number: 5,809,900

[45] Date of Patent: Sep. 22, 1998

[54] CABLE STORAGE BAG FOR A WORKSTATION

[75] Inventors: Brian D. T. Alexander, Fennville; Jeffrey Reuschel, Hamilton, both of Mich.

[73] Assignee: Haworth, Inc., Holland, Mich.

[21] Appl. No.: 649,002

[22] Filed: May 16, 1996

[51] Int. Cl.[6] ..... A47B 85/00

[52] U.S. Cl. ..... 108/26; 108/50.11

[58] Field of Search ..... 108/25, 26, 50; 312/223.6, 223.1, 223.2; 150/106, 114, 120, 121, 122

[56] References Cited

U.S. PATENT DOCUMENTS

| | | | |
|---|---|---|---|
| 2,140,685 | 12/1938 | Baxter | 108/25 X |
| 2,241,309 | 5/1941 | Kovalik | 108/25 X |
| 3,034,153 | 5/1962 | Sargent | 108/25 X |
| 3,042,467 | 7/1962 | Germick | 108/25 X |
| 4,974,620 | 12/1990 | Quillan et al. | 108/25 X |

OTHER PUBLICATIONS

*Architectural Record*, "Teamwork Kit–of–Parts", May 1995 (1 page).

*Facilities Design & Management*, "Hotline", May 1995 (2 pages).

*Contract Design*, "The Future Arrives–in 1995?", May 1995 (1 page).

*Primary Examiner*—Jose V. Chen

*Attorney, Agent, or Firm*—Flynn, Thiel, Boutell & Tanis, P.C.

[57] ABSTRACT

A cable storage bag formed of a single unitary sheet of flexible material which includes a plurality of flaps that are foldable one over the other to define a pouch-like hollow interior. The folded flaps define a cable bag having a closable top cover flap having separate independently closable halves to permit entry and exit of cables being stored within the hollow interior. The cable bag includes upper and lower cable ports generally disposed near the upper and lower corners of the cable bag and a central cable port formed between the independently movable halves of the cover flap. A plurality of straps are provided within the cable bag interior so as to facilitate storage and restraining of excess cabling therein as well as electrical components and accessories.

18 Claims, 5 Drawing Sheets

CABLE STORAGE BAG FOR A WORKSTATION

FIELD OF THE INVENTION

This invention relates to means for managing cables at a workstation of an office furniture arrangement and more particularly, to a cable storage bag adapted to mount to a furniture component and receive and store cables and electrical components therein.

BACKGROUND OF THE INVENTION

Conventional wall panels which are frequently used to construct workstations in an office environment or business typically include interior passages and storage areas for management of electrical and communication cables being routed to each workstation. However, to provide more flexibility in office areas, workstations also are being formed by arrangements of readily movable components such as transportable tables, divider screens, and freestanding cabinets which open to define a workstation. Unlike wall panel arrangements, however, these transportable furniture components, particularly those of less complex design, typically do not include separate storage chambers for electrical, communication and computer cabling. This may result in exposed clusters of cables which may not only be unsightly, but also undesirable with respect to safety considerations.

It is therefore an object of the invention to provide means for storing workstation cabling and other electrical components being used on transportable furniture components, such as computer support stands, divider screens and the like. It is further an object of the invention to provide a cable storage bag which serves to store cables therein and is readily repositionable on a furniture component adjacent to a worksurface while providing ready access for the insertion and storage of cable therein. It is a further object to provide cable access ports for routing of cabling along a variety of paths into and out of the cable bag. It is still a further object that the cable storage bag positively restrain the cabling and electrical components within the storage bag while being of a cost efficient construction of reduced complexity.

The invention relates to a cable storage bag formed of a single unitary sheet of flexible material which includes a number of flaps that are folded one over the other to define a pouch-like hollow interior. The folded flaps define front and back walls, the horizontal top edges of which define a top opening into the hollow interior. To enclose the top opening, a top flap is joined to the back wall along the top edge thereof and is foldable downwardly over the top opening.

The folding of the flaps further defines cable ports at the four corners of the bag to permit cables to be routed into and out of the cable bag. A further cable port is provided by an opening formed in the cover flap. To further assist in the routing of cables into the cable bag, the cover cable port divides the cover flap into two halves which are each independently foldable to open and close left and right halves of the top opening.

The cable bag further includes within the interior thereof looped elastic straps which are adapted to receive an electrical component such as a receptacle or plug strip in tight fitting engagement. Such positive retention of the plug strip allows for selective connection of cable plugs to the receptacles within the storage bag itself. Additionally, the interior of the storage bag is provided with pairs of cooperating velcro straps which are used to fixedly secure the cables or other articles being stored within the bag.

The cable bag also includes mounting clips which are detachably connectable to a furniture component. Preferably, the furniture component offers a plurality of mounting locations for the cable bag. For example, the furniture component may include a ladder-like arrangement of cross members or have perforated panels with openings from which the cable bag may be suspended. More particularly, the cable bag itself includes a pair of spring clips or hook-like projections which are fixed to the back outer surface of the bag and extend into openings on the furniture component so as to hang from the cross members or the perforated panel.

Other objects and purposes of the invention will be apparent to persons familiar with structures of this general type upon reading the following specification and inspecting the accompanying drawings.

Figure 2:
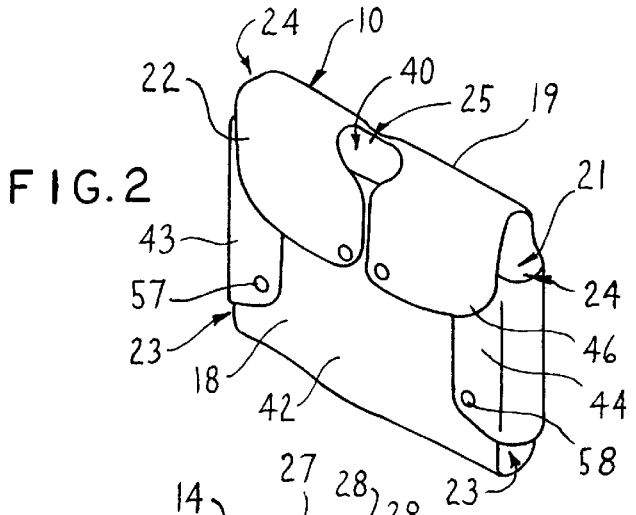
FIG. 2 is an enlarged front perspective view of one of the cable bags of FIG. 1.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Figure 1:
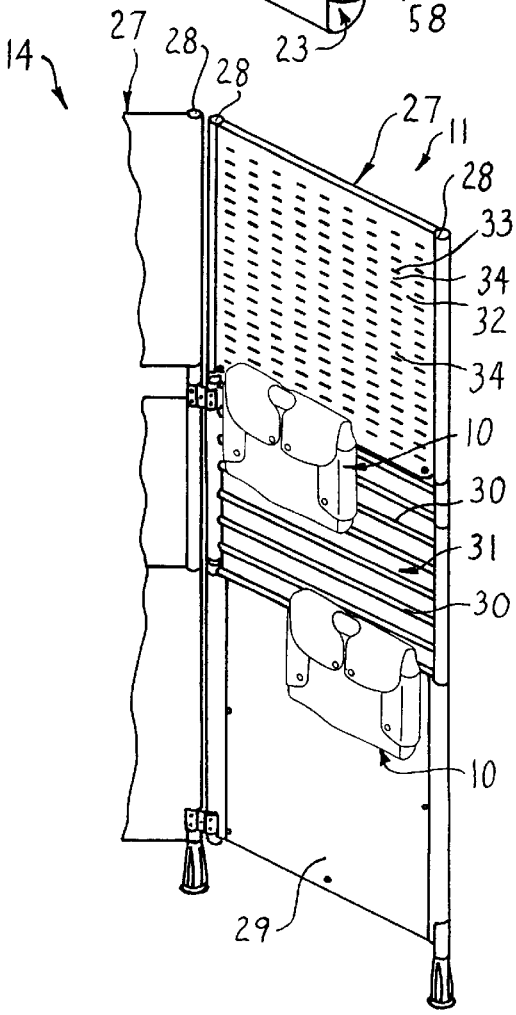
FIG. 1 a partial perspective view of a workstation having a divider screen with cable storage bags of the invention mounted thereon in alternative mounting locations.

Referring to FIG. 1, the invention relates to a cable storage bag 10 used in combination with a workstation 11 where the cable storage bag 10 stores excess sections of electrical and communication cabling 12 being routed to furniture components such as a divider screen 14.

Generally, the workstation 11 (FIG. 1) is formed from a variety of movable furniture components including a divider screen 14. Besides furniture components, the workstation typically will include office equipment, such as a computer as well as telephones, lighting and the like which require connection to electrical or communication cabling 12 but typically both.

Figure 3:
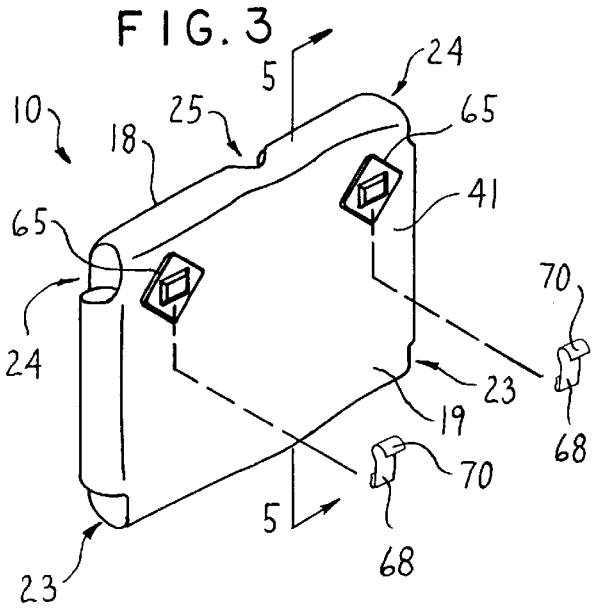
FIG. 3 is a perspective view from a rear side of the cable storage bag of FIG. 2.

To facilitate management of such cabling 12 which typically has a surplus length, one or more of the cable bags 12 are mounted in the workstation 11, either on a table (not illustrated) so as to be movable therewith or on the divider screen 14. To effectively eliminate unsightly and potentially hazardous collections of excess cabling hanging on and around the workstation 11, the cable storage bag 10 is readily mountable to a plurality of locations within the workstation area 11 (FIG. 1). Referring to FIGS. 2 and 3, the cable bag 10 generally includes front and back walls 18 and 19 which are joined together along three sides thereof so as to define an upward opening pouch having a hollow interior 21 for receiving the excess cabling. To close the cable bag 10, a cover flap 22 is joined to the back wall 19 while pairs of lower cable ports 23, upper cable ports 24 as well as a central cable port 25 permit access to the hollow interior 21. With this arrangement, excess cable 12 is readily accommodated.

More particularly, while the cable bag 10 can be mounted to a variety of furniture components, one furniture component is the tri-fold divider screen 14 having three hingedly connected sections 27, the middle and right sections 27 being illustrated in FIG. 1. Each section 27 includes a pair of spaced apart vertical uprights 28 having a solid planar lower panel 29 connected therebetween. In the illustrated rightward section 27, upwardly from the panel 29, the vertical uprights 28 include a ladder-like arrangement of vertically spaced cross members 30 connected therebetween which define horizontally elongate spaces or openings 31. Upwardly of the cross members 30, the rightward section 27 includes a planar perforated panel 32 connected between the uprights 28 which includes a plurality of vertically and horizontally spaced rows of rectangular spaces or openings 33 formed therethrough with uninterrupted panel regions 34 disposed between the openings 33. These rectangular openings 33 either in the perforated panel 32 or alternatively, the cross members 30 themselves provide a plurality of mounting locations for the cable storage bag 10.

An alternative example of a furniture component on which the cable bag can be mounted and which has a ladder-like arrangement of cross-members is disclosed in U.S. patent application Ser. No. 08/459 329, filed Jun. 2, 1995, the disclosure of which is incorporated herein by reference.

Figure 7:
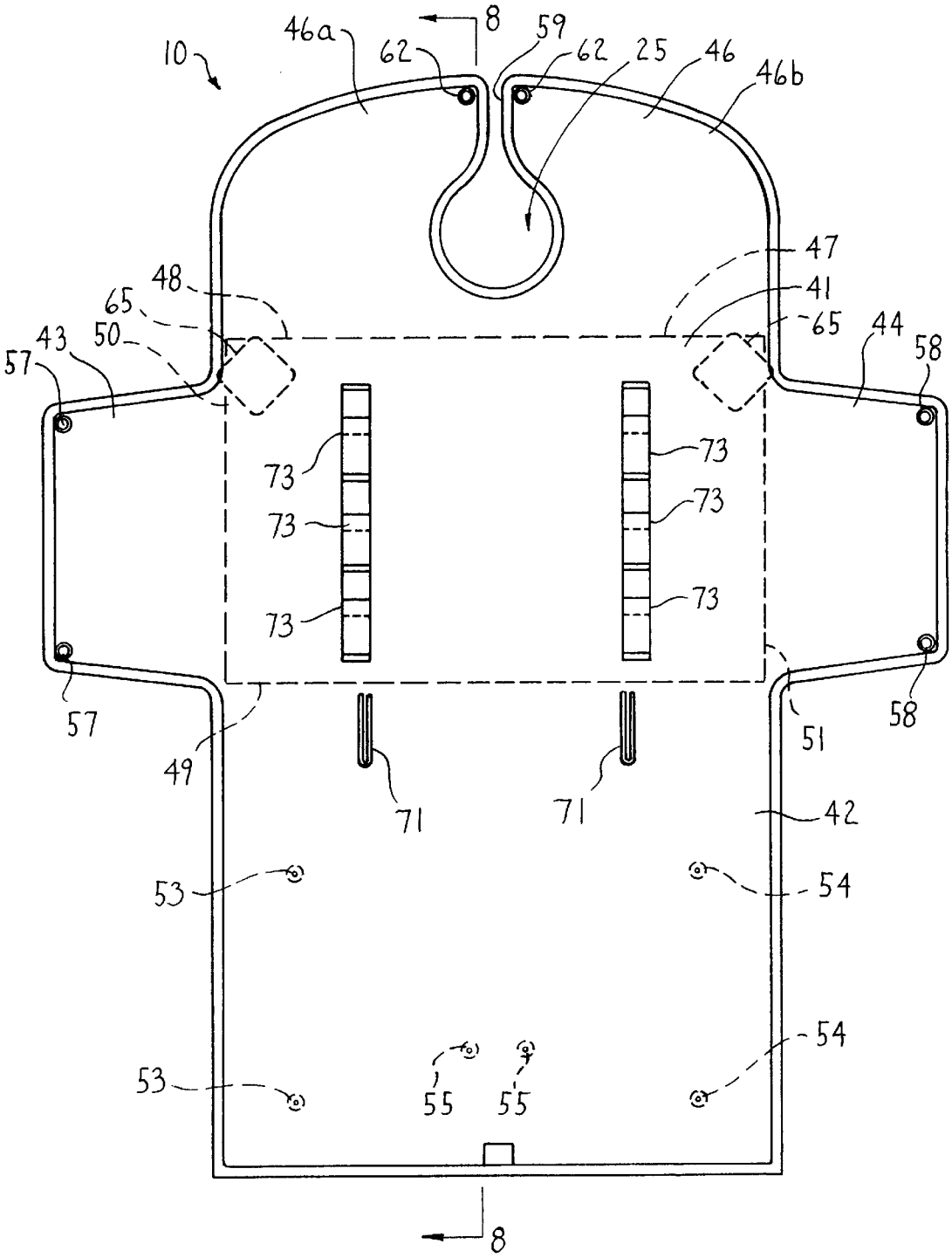
FIG. 7 is a plan view of the cable bag of FIGS. 1–5 in an unfolded condition.
Figure 9:
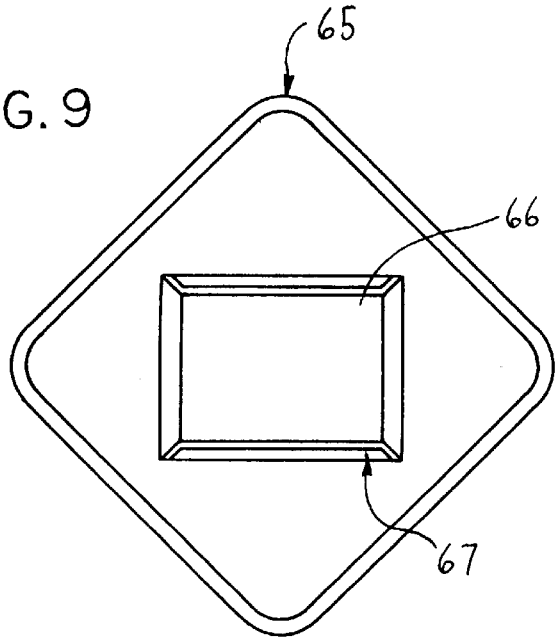
FIG. 9 is a front view of clip retainers which connect on a back side of the cable bag of FIG. 3.
Figure 10:
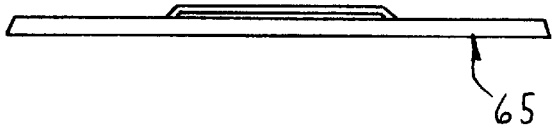
FIG. 10 is a bottom elevational view of the grommet illustrated in FIG. 9.

Referring generally to FIGS. 2 and 7, the cable storage bag 10 is formed of a single unitary sheet of flexible material which includes a number of flaps that are folded one over the other to define the pouch-like hollow interior 21 which opens upwardly through a top opening 40. While the back wall 19 is formed by a central back panel 41, the front wall 18 is formed by a bottom flap 42 foldable upwardly so as to overlie the back panel 41, and left and right side flaps 43 and 44 which each are foldable laterally so as to overlie the bottom flap 42, which flaps are then connected together. To substantially close the top opening 40, the cable bag 10 further includes a cover flap 46 which is foldable downwardly so as to overlie the front wall 18 defined by the bottom flap 42 and the left and right side flaps 43 and 44.

Figure 8:
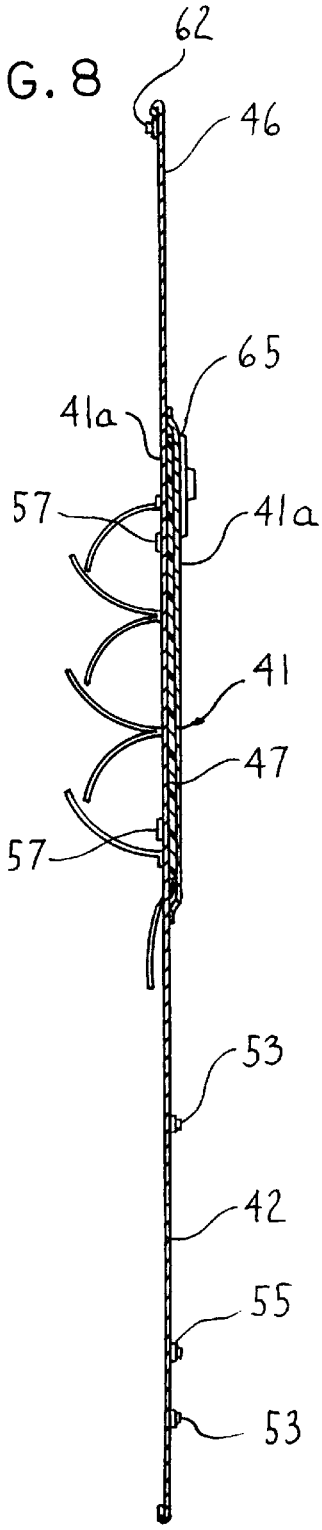
FIG. 8 is a side elevational view of the unfolded cable bag of FIGS. 1–5 illustrating pairs of velcro straps mounted thereon.

More particularly, with reference to FIG. 7, which illustrates the embodiment of the cable bag 10 of FIGS. 1–3, the rectangular central back panel 41 is joined on four sides by the cover flap 46, the bottom flap 42 and the left and right side flaps 43 and 44. The sheet is made of an appropriate foldable and flexible cloth-like or fabric-like material that allows folding of the flaps in order to construct the cable bag 10. To provide rigidity to the cable storage bag 10, the back panel 41 includes two layers 41*a* (FIGS. 7 and 8) of fabric material which define a pocket and enclose a substantially rectangular plastic insert 47 formed of plastic or other material so as to provide at least limited rigidity. The plastic insert 47 defines a horizontal top edge 48, a horizontal bottom edge 49, a vertical left side edge 50 and a vertical right side edge 51 of the back panel 41. The terms "vertically" and "horizontally" are used herein to describe the components of the cable bag 10 as oriented when positioned for use (FIG. 1).

The bottom flap 42 is connected to said back panel 41 continuously along said bottom edge 49 and is generally foldable upwardly so as to overlie the back panel 41. To effect construction of the cable storage bag 10, the bottom flap 42 includes a first pair of snap connector parts 53 (FIGS. 7 and 8) which are disposed in a vertically spaced relation proximate a left side of the bottom flap 42 and preferably are snap connectors of conventional construction. The bottom flap 42 also includes a second pair of snap connector parts 54 disposed along the opposite right edge region of the bottom flap 42, and further includes a pair of third snap connector parts 55 disposed in the central region intermediate the left and right sides of the bottom flap 42. Preferably, the first, second and third pairs of connector parts 53, 54 and 55 comprise male connectors of a conventional snap fastener, which male snap connectors are mounted to an exterior surface of the bottom flap 42 so as to be accessible from an exterior of the cable storage bag 10.

The left and right side flaps 43 and 44 similarly are generally foldable about the left and right side edges 50 and 51 so as to overlie the bottom flap 42 when disposed in the folded position illustrated in FIG. 1. The left and right side flaps 43 and 44 include respective pairs of first and second side snap connector parts 57 and 58. The first and second side connector parts 57 and 58 preferably are female connectors of a conventional snap fit arrangement which are positioned so as to snap fittingly engage the corresponding first and second male connector parts 53 and 54 of the bottom flap 42 as generally illustrated in FIG. 2. As a result, the connected left and right side flaps 43 and 44 and the bottom flap 42 define the front bag wall 19 of the cable storage bag 10 while the back panel 41 defines the back bag wall 20.

Figure 5:
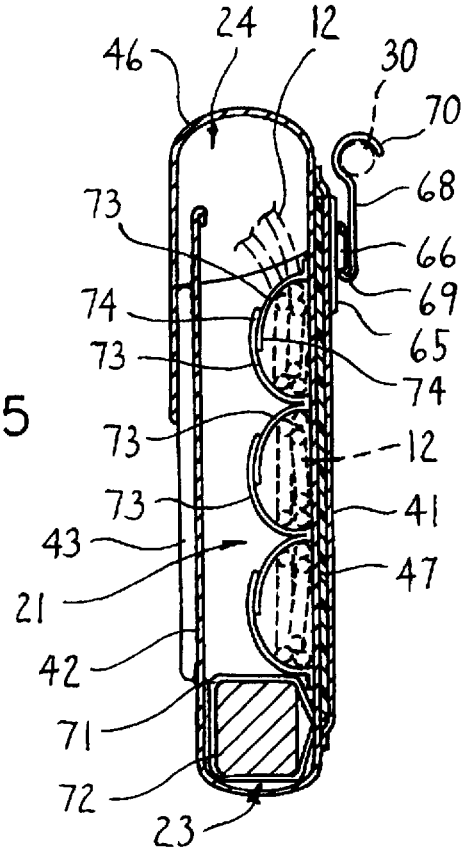
FIG. 5 is a side cross-sectional view of the cable bag as viewed in the direction of arrows 5—5 of FIG. 3.

When in the folded positions of FIG. 2, gaps are formed between the left and right side flaps 43 and 44 and the bottom flap 42. These gaps define the left and right lower cable ports 23 (FIGS. 2, 3 and 5) which provide access to the hollow interior 21 of the cable storage bag 10.

The cover flap 46 (FIG. 4) extends upwardly away from the top edge 48 of the back panel 41. The cover flap 46 is divided into a left portion 46*a* and a right portion 46*b* which are separated one from the other by a slot 59 which is enlarged proximate the top edge 48 so as to define the central cable port 25 therebetween. The cover flap 46 further includes a laterally spaced pair of snap connector parts 62 disposed on each of the left and right cover portions 46*a* and 46*b*. Preferably the third connector parts 62 are the female snap connectors which are positioned on the interior surface of the cover flap 46 for snap fitting engagement to the male snap connector parts 55 of the bottom flap 42. As a result, the top opening is selectively closable by folding of the cover flap 46 over the opening either by folding of the left or the right portions 46*a* or 46*b* independently or both together and thereafter, snapping the male and female snap connector parts 55 and 62 together as generally illustrated in FIG. 2. Besides the central cable port 25, the gaps between the cover flap 46 and the left and right side flaps 43 and 44 further define the left and right upper cable ports 24.

Figure 11:
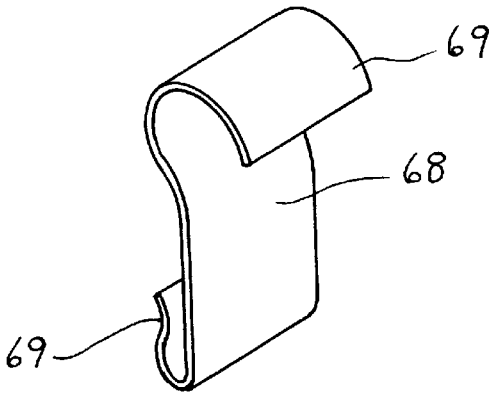
FIG. 11 is a perspective view of a spring clip for connecting the cable bag in place.

Referring to FIGS. 3, 5, 9 and 10, mounting means are provided on the cable storage bag 10 for connection of the bag 10 to the furniture component 11. The mounting means comprise a pair of clip holders 65 which are fixedly secured to an exterior surface of the back panel 41. Each clip holder 65 includes a raised central section 66 which defines an upwardly and downwardly opening passage or seat 67. The clip holders 65 are connected to the back wall 19, for example, by sewing and are disposed proximate the upper left and right corners thereof. The mounting means further includes a S-shaped spring steel clip 68 (FIGS. 3, 5 and 11) having an upwardly extending lip 69 which is slidably received within the seat 67 of the clip holder 65. The spring clip 67 further includes a downwardly directed hook-like lip 70 which is dimensioned so as to fit into a selected one of the openings 31 or 33 so as to hang from the uninterrupted support regions 34 of the perforated panel 32 against the wall structure disposed downwardly therefrom. Additionally, the hook-like lip 70 is resiliently flexible and dimensioned so as to snap onto the outer periphery of the tubular cross members 30 (FIGS. 1 and 5) of the furniture component 14 and hang downwardly against lower ones of said cross members 30.

To facilitate management of the cables and electrical components within the hollow interior of the storage bag 10, the back panel 41 preferably includes a pair of straps 71 which are formed in a closed loop and are spaced apart laterally proximate the bottom edge 49 thereof. Preferably, the straps 71 are elastic and define an expandable opening therethrough so as to permit tight fitting insertion of an electrical component such as a conventional plug strip 72 (diagrammatically illustrated in FIG. 5) or other type of receptacle or article being stored with the hollow interior 21. Alternatively, the straps 71 can be formed of two connectable sections or the like.

Additionally, connectable pairs of straps 73, preferably three pairs formed of velcro, are also secured to the back panel 41 to permit securing of the cables 12 therein. The straps 73 are fixed at one end to the back panel 41 and have free ends 74 extending outwardly therefrom which engage the free end 74 of the other of the pair of straps 73 to define a closed loop. Alternatively, the straps 73 could be formed as loops of an elastic material, which also can be used to retain electrical components therein.

With this arrangement, coiled loops or lengths of excess cabling 12 (FIG. 5) can be stored and restrained within the hollow interior 21 of the cable storage bag 10. The cable storage bag 10 offers a number of entry and exit locations and more particularly, includes upper and lower cable ports 24 and 23 as well as central cable port 25 which further facilitate cable management. To also positively restrain electrical components within the interior 21, at least one pair of straps 71 which preferably are elastic but also may be velcro or other connectable straps are provided therein which are wrapped about the electrical component 72. With the electrical component 72 which may be a plug strip, connections of electrical plugs to receptacles can occur within the cable bag 10. Pursuant to current wiring practices, however, the cabling 12 typically will be limited to either electrical or communication but not both since this contravenes current industry practice.

Figure 6:
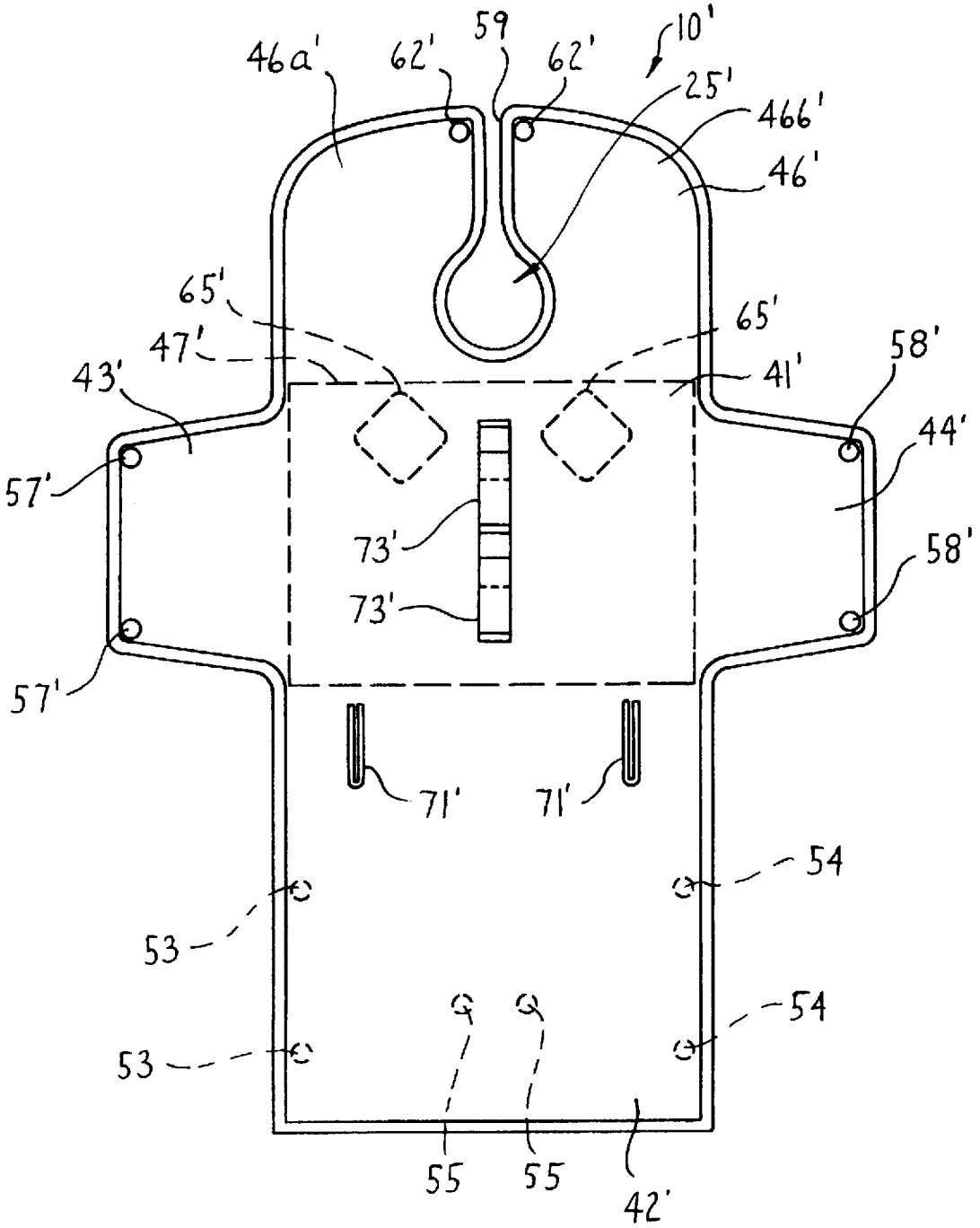
FIG. 6 is a plan view of the cable storage bag in an unfolded condition.

Referring to FIG. 6, a cable bag 10' is illustrated which generally is a smaller version of the cable bag 10. The cable bag 10' includes the same arrangement of a center back panel 41' which is connected to a bottom flap 42', left and right side flaps 43' and 44' and a cover flap 46'. The components are substantially the same as those described hereabove except that due to the smaller dimensions of the cable bag 10', only two pairs of straps 73' are provided and the remaining components are spaced closer together.

Figure 4:
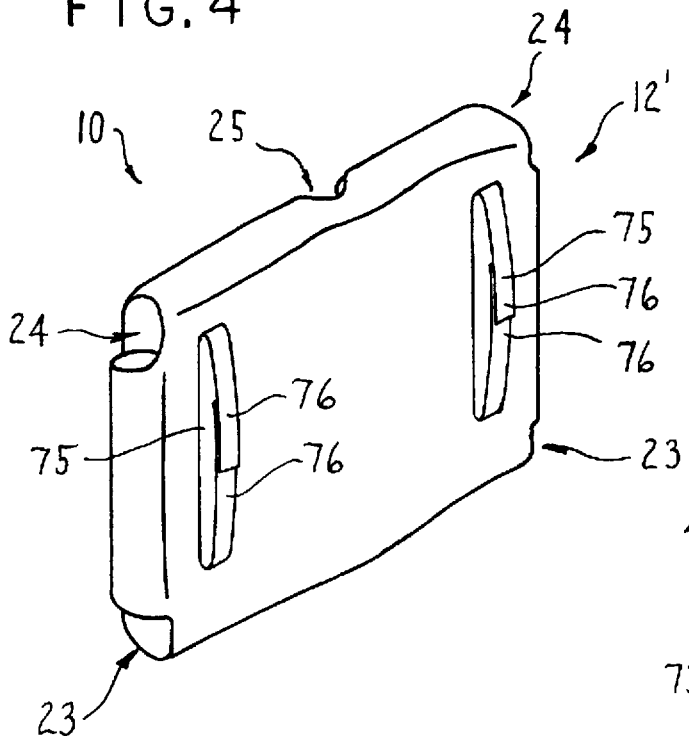
FIG. 4 is a rear perspective view of an alternative embodiment of the invention.

In still a further alternative embodiment illustrated in FIG. 4, alternative mounting means may be provided for connection of the cable bag 10 to a structural support member of a furniture component 14 which alternate mounting arrangement includes left and right straps 75 which are connectable one with the other, for example, by the use of velcro. The straps 75 are connected to the back wall 19 along a substantial portion of the height thereof and have free ends 76 which extend outwardly and are connectable one with the other so as to permit wrapping about a structural member and then securing the straps 75 into a closed loop.

The embodiments of the invention in which an exclusive property or privilege is claimed are defined as follows:

1. A cable bag for storing cables of a workstation comprising:

opposing front and back bag walls connected one with the other along first and second spaced apart side edges which extend generally upwardly and along a laterally extending bottom edge thereof, said bag walls defining a hollow interior which opens upwardly through a top opening defined by laterally extending top edges of the front and back bag walls, said first side edge including an openable first side flap which connects said front and back bag walls together and is laterally foldable to permit access to said hollow interior through said first side edge;

mounting means connected to said back bag wall on an exterior surface thereof for removably attaching said cable bag to a furniture component;

at least first and second lower cable ports formed through said cable bag in communication with said hollow interior which are disposed proximate said bottom side edge near said first and second side edges respectively;

a cover flap connected to one of said top edges so as to be foldable in a vertical plane and enclose a substantial portion of said top opening, said cover flap further including an intermediate cable port disposed intermediate said first and second side edges so as to be in communication with said hollow interior through said top opening;

first and second upper cable ports formed through said cable bag in communication with said hollow interior which are disposed proximate said top edge near said first and second side edges respectively;

at least one retaining strap connected to said back bag wall in said hollow interior, said retaining strap being formed in a closed loop and defining an opening through which a cabling component is adapted to be tight fittingly received for storage within said cable bag;

pairs of connectable straps each having a fixed end connected to said back bag wall of said cable bag within said hollow interior and a free end adapted to connect with said free end of another of said straps so as to define a variable opening for securing cable components; and whereby workstation cables are selectively routed into and out of said hollow interior of said cable bag through one or more of said upper and lower cable ports and said central cable port.

2. A cable bag according to claim 1, wherein said back bag wall comprises two flexible sheets of bag material defining an enclosed pocket having a generally rigid insert disposed therein, said front bag wall being a flexible material.

3. A cable bag according to claim 2, wherein said front bag wall comprises a bottom flap which is connected to said back bag wall along said bottom edge, said bottom flap being foldable upwardly about said bottom edge so as to overlie said back bag wall.

4. A cable bag according to claim 3, wherein said front bag wall further includes said first side flap and a second side flap respectively connected to said back bag wall along said first and second side edges and being foldable laterally about said side edges so as to overlie said back bag wall, fastener means being interconnected between said first and second side flaps and said bottom flap for connecting said first and second side flaps to said bottom flap in a position overlying said back bag wall and defining said front bag wall.

5. A cable bag according to claim 4, wherein said lower cable ports are each defined by a gap formed between said bottom flap and said respective first and second side flaps.

6. A cable bag according to claim 2, wherein said mounting means comprises a rigid retainer mounted to said back bag wall which defines a downward opening slot and an S-shaped clip having an upwardly extending first hook engaged upwardly into said slot of said retainer and a downwardly extending second hook adapted to be received in a corresponding opening of a furniture component.

7. A cable bag according to claim 1, wherein a plurality of said pairs of connectable straps are connected to said back bag wall vertically one above the other.

8. A cable bag formed of a sheet of bag material comprising;

a generally rigid back portion which is disposed centrally of said sheet of bag material and defines a back wall of said cable bag, said back portion having a generally rectangular shape defined by first and second side edges which are spaced apart one from the other and extend generally upwardly and by top and bottom edges which extend generally laterally between said first and second side edges;

a flexible bottom flap connected to said back portion along said bottom edge, said bottom flap being foldable vertically generally about said bottom edge to a folded position so as to overlie said back portion;

flexible first and second side flaps connected to said back portion along said respective first and second side edges, said first and second side flaps being foldable laterally about said first and second side edges so as to overlie said back portion, said first and second side flaps disposed in a facing relation with said bottom flap which also overlies said back portion in opposing relation therewith to define a front wall of said cable bag in an opposing relation with said back wall;

first connector means for connecting said respective first and second side flaps with said bottom flap so that a hollow interior is formed in the region between said front wall defined thereby and said back wall, said top edge of said back wall and a top edge of said front wall defining a top opening which opens into said hollow interior, said first connector means being disconnectable so as to permit disconnection of one of said first and second side flaps from said bottom flap for accessing said hollow interior while the other of said first and second side flaps supports said bottom flap in said folded position;

first and second lower cable ports defined proximate said bottom edge near said first and second side edges, said lower cable ports defined by gaps formed between said respective first and second side flaps and said bottom flap when folded together;

a flexible cover flap being connected to said back portion along said top edge thereof and being foldable in a vertical plane about said top edge, said cover flap substantially enclosing said top opening;

second connector means for removably connecting a free end of said cover flap to said front wall when folded;

mounting means connected to said back portion on an exterior surface thereof for removably attaching said back portion of said cable bag to a furniture component; and first and second upper cable ports disposed proximate said top edges near said first and second side edges, said upper cable ports defined by gaps formed between said first and second side flaps and said cover flap.

9. A cable bag according to claim 8, wherein said cover flap includes a cover cable port formed therethrough in communication with said hollow interior through said top opening.

10. A cable bag according to claim 8, wherein said sheet of bag material includes resilient closed-loop straps which are connected to the back portion so as to be disposed within said hollow interior after folding, and at least one pair of connectable straps connected to the back portion which have one end fixed to said sheet and free ends adapted to connect together for retaining cabling therebetween, said connectable straps being disposed within said hollow interior.

11. A cable bag according to claim 8, wherein said mounting means include a clip connected to said back wall and adapted to insert through an opening in said furniture component so as to engage a fixed member thereof.

12. A cable bag according to claim 11, wherein said mounting means further includes a clip holder mounted to said exterior surface which includes a downwardly opening recess, said clip including an upwardly directed hook seated within said recess and a downwardly directed hook for connection to said furniture component.

13. An office furniture arrangement comprising:

a furniture component having a vertically enlarged wall structure;

a plurality of cables for said furniture component and a plug strip adapted to be connected to said cables; and a cable bag mounted to said furniture component for storing said cables and said plug strip therein comprising vertically enlarged front and rear bag walls connected one with the other along a laterally extending bottom edge thereof, said rear bag wall being generally rigid and said front wall being flexible so as to be foldable vertically about said bottom edge between an unfolded position and a folded position overlying said rear bag wall in opposing relation therewith, said opposing bag walls defining a hollow interior which opens upwardly from top edges of the front and rear bag walls, one of said bag walls including side flaps on opposite side edges thereof, said side flaps being flexible so as to be foldable about said side edges and including connector means on free ends thereof for connecting said front and rear bag walls together in said opposing relation, said side flaps permitting access to said hollow interior by disconnecting one of said side flaps while the other of said side flaps supports said front bag wall in said folded position, a pair of lower cable ports being formed through said cable bag in communication with said hollow interior which are respectively disposed proximate the juncture between said bottom side edge and said first and second side edges;

mounting means being disposed on said rear bag wall for suspending said rear bag wall from said wall structure;

a cover flap being connected along one of said top edges so as to enclose a substantial portion of said top opening, first and second top cable ports being defined in said cable bag in communication with said hollow interior proximate the juncture between said one of said top edges and said first and second side edges, said cover flap further including an intermediate cable port disposed intermediate said first and second side edges so as to be in communication with said hollow interior;

at least one retaining strap formed in said cable bag as a closed loop defining an opening through which said plug strip is adapted to be tight fittingly received for storage within said cable bag; and at least one pair of connectable straps each having a fixed end connected to said rear bag wall in a spaced apart relation within said hollow interior and a free end adapted to connect with said free end of another of said connectable straps so as to define a variable opening for receiving said cables;

said cables extending into and out of said hollow interior of said cable bag through one or more of said upper and lower cable ports and said intermediate cable port, said plug strip being fitted within said intermediate of said looped retaining strap to allow for connections with said cables therein, said connectable straps and said retaining strap supporting said cables and said plug strip when said front bag wall is in said unfolded position.

14. The office furniture arrangement according to claim 13, wherein said at least one retaining strap is an elastic member such that said opening is expandable.

15. The furniture arrangement according to claim 13, wherein said at least one retaining strap is disposed proximate said bottom edge of said cable bag within said hollow interior such that said plug strip is supported by said front and rear bag walls when in said opposing relation, said at least one retaining strap being disposed proximate said lower cable ports.

16. The office furniture arrangement according to claim 13, wherein said pair of connectable straps include velcro fasteners on said free ends thereof.

17. The office furniture arrangement according to claim 16, wherein a plurality of said pairs of connectable straps are connected to said rear bag wall.

18. The office furniture arrangement according to claim 13, wherein said rear bag wall includes a plastic rectangular insert which defines said bottom, top and side edges thereof.

* * * * *

UNITED STATES PATENT AND TRADEMARK OFFICE

CERTIFICATE OF CORRECTION

PATENT NO. : 5 809 900

DATED : September 22, 1998

INVENTOR(S) : Brian D.T. ALEXANDER et al

It is certified that error appears in the above-identified patent and that said Letters Patent is hereby corrected as shown below:

Column 9, line 26; change "within said intermediate of" to ---within said opening of---.

Signed and Sealed this

Eighteenth Day of May, 1999

*Attest:*

Q. TODD DICKINSON

*Attesting Officer*

*Acting Commissioner of Patents and Trademarks*